United States Patent [19]

D'Angelo et al.

[11] 4,272,311

[45] Jun. 9, 1981

[54] METHOD AND APPARATUS FOR AUTOMATICALLY LABELLING CONTAINERS

[76] Inventors: Joseph J. D'Angelo, 378 Annette Ct., Wycoff, N.J. 07481; Joseph J. D'Angelo, Jr., 53 Iroquois Ave., Oakland, N.J. 07536

[21] Appl. No.: 39,755

[22] Filed: May 17, 1979

[51] Int. Cl.[3] ..... B26D 5/02; B65C 3/00

[52] U.S. Cl. ..... 156/215; 156/250; 156/252; 156/353; 156/361; 156/449; 156/475; 156/522; 156/DIG. 13; 156/DIG. 40; 156/DIG. 41

[58] Field of Search ..... 156/215, 265, 455, 449, 156/522, 361, 362, 363, 475, DIG. 10, DIG. 11, DIG. 13, DIG. 40, DIG. 41, 250

[56] References Cited

U.S. PATENT DOCUMENTS

| | | | |
|---|---|---|---|
| 3,178,329 | 4/1965 | Rohbogner | 156/522 |
| 3,367,822 | 2/1968 | Hoffler | 156/363 |
| 3,553,049 | 1/1971 | Wolff | 156/362 |
| 3,594,257 | 7/1971 | Von Hofe | 156/361 |

*Primary Examiner*—Caleb Weston

*Attorney, Agent, or Firm*—Parmelee, Johnson, Bollinger & Bramblett

[57] ABSTRACT

Fully automated method and apparatus are provided for labelling containers, including supplying and applying labels. A supply provides a web of preprinted labels which may be pre-perforated for easy separation. This web of labels is fed past a sensing device and an adhesive applicator. A clamp temporarily clamps the web in response to signals from the sensor during separation of the leading label from the web. The leading edge of each label is fed to a label-engaging station with the adhesive-coated surface facing the container to which it is to be applied. Conveyor means continually transport a sequence of individual containers to said station where the respective container contacts the adhesive-coated label end. Immediately, the container begins to be rolled in a labelling channel defined between a continuously revolving belt having a friction surface and an opposed stationary wall for wrapping the label firmly around the container rolling along this channel. Pinch means at the upstream end of this channel drive the respective container into firm contact with the adhesive-surface of the label end while pressing the outside of the label against the revolving belt, thereby commencing rolling the container within the channel. After a predetermined amount of wrapping, the web is temporarily clamped, and the label is separated from it. Following the label separation, the container continues to be rolled along the channel for completely wrapping the label securely. In an alternative embodiment, the label so wrapped may be heat sealed.

13 Claims, 9 Drawing Figures

METHOD AND APPARATUS FOR AUTOMATICALLY LABELLING CONTAINERS

BACKGROUND OF THE INVENTION

This invention relates to method and apparatus for automatically labelling containers, and more particularly to such method and apparatus for automatically applying labels to containers having a generally circular cylindrical body such that the containers can be rolled along a channel.

Labelling of containers particularly of the molded plastic variety having a generally circular cross-section is time-consuming and costly. Many labels in use today are supplied with pressure-sensitive adhesives which deteriorate with time and accordingly lose their adhesive qualities. In other words, the pressure-sensitive labels have a "limited shelf life". Such pressure-sensitive adhesive labels also cause problems in storing, are expensive and normally require a throw-away peelable backing strip for transporting and protecting the pressure-sensitive adhesive on the labels before use. When applying such labels, the backing strip must be removed before the label is mounted on the container, which is both time-consuming and a waste of the backing material and labor.

Another method employed in labelling cylindrical containers having circular cross-sections involves slightly stretching and slipping a pre-formed tubular label over the cylinder to be held thereon frictionally by being stretched around the cylinder. This type of labelling requires a difficult and time consuming manual operation as well as requiring pre-formed tubular labels of the proper critical size. If the tubular label is slightly too large, it is loose and slack and useless. If it is slightly too small, the exertion involved in stretching it around the container usually results in tearing or rupture of the label.

SUMMARY OF THE INVENTION

Accordingly, it is an object of this invention to provide a new and novel method and apparatus for automatically labelling containers which are very effective and reliable in practice and produce striking economies in labelling costs.

A further object of this invention is to provide a new and novel method and apparatus for automatically labelling containers which permit the use of large supply rolls of preprinted labels which can be conveniently shipped and stored for long periods of time.

Another object of this invention is to provide a new and novel method and apparatus for automatically labelling containers which does not waste material.

Still a further object of this invention is to provide a new and novel method and apparatus for applying labels in which the adhesive is applied immediately prior to the labelling operation, and accordingly does not lose its adhesiveness, thereby, avoiding problems of shelf-life limitations or stale labels and preventing the labelling from soon becoming loose or unreliable.

It is among the many advantages of the present invention that it enables a pre-printed roll of non-adhesive labels to be applied in a quick, convenient and reliable manner, thereby avoiding any need for use of a throw-away backing strip and avoiding any problem of adhesive becoming stale.

It is among the further advantages of this invention in certain embodiments thereof that it enables a roll of pre-printed labels on heat-sealable material to be wrapped around a container in a quick, convenient manner, then using heat to seal the overlapped ends of the label together.

A further advantage of this invention in certain embodiments is that it enables the pre-printing to be in reverse image on the inside surface of a transparent area of label material because the label is affixed to the container in ways which do not obscure the printing which can be viewed through the transparent material and which is protected by the label material itself.

Furthermore, this invention enables the high-speed efficient pre-printing of wide webs of label material containing many parallel rows of labels. Then the wide web is slit into individual narrower webs which are one label in width and contain a row of labels adapted to be rolled up and shipped to the user for applying to containers as described.

In carrying out this invention in one illustrative embodiment thereof, method and apparatus are provided for automatically labelling containers by transporting a series of individual containers by conveyor means to a label-engaging station. A continuous web of preprinted labels, which may also be pre-perforated, is fed from a roll or zig-zag stack past a sensor for sensing registration indicia on each label as the web is fed toward the label-engaging station. The web is fed past an adhesive applicator which selectively applies adhesive to the web of preprinted labels. Next the web passes a clamp which is responsive to the sensor for temporarily clamping the web during the separation of the leading label from the web. The leading edge of each label in the web is fed to the label-engaging station with the adhesive surface thereon facing the respective containers which are being transported by the conveyor in sequence to the label-engaging station.

A continuously revolving belt having a friction surface thereon forms a moving wall extending along on one side of the conveyor means and along with an opposed wall on the opposite side of the conveyor forms a conveyor channel along which each container is rolled after it has engaged the leading edge of the label for wrapping the label around the container. A pinch roller at the upstream end of the labelling channel drives the container into firm contact with the adhesive surface of the leading edge of the label while pressing the outside of the label against the continuously revolving belt which commences rolling the container along in the conveyor channel to wrap the label around the container. During the wrapping operation, the clamp is temporarily actuated while the label is being separated from the web, the clamp is released, while the container continues to roll along in the conveyor channel to finish the wrapping operation. Separation may be accomplished by striking the container with an advancing impulse while the clamp is actuated and after the label is partially wrapped around the container; alternatively, the label may be cut by a knife or a hot wire while clamping takes place. In an alternative embodiment, the label may be heat sealed on the container after it has been wrapped around the container.

By virtue of the aforesaid method and apparatus, a large high-speed printing machine can be used to preprint many parallel rows of labels on a wide web of plastic material. This high-speed printing can advantageously be by reverse printing on the inside of a wide web of transparent plastic material. The web may then be sliced longitudinally into many individual narrow webs each of which contains a single row of labels and is wound on an individual roll or formed into a zig-zag packet facilitating the convenient shipping and storage of such rolls or packets until utilized in the labelling process. Since at this stage no adhesive is placed on the labels, the roll or packet has a long shelf life because there is no adhesive to deteriorate. During the labelling, adhesive is only applied to each label as required, and that application is immediately prior to the labelling operation, which conserves material and prevents the adhesive from becoming stale.

BRIEF DESCRIPTION OF THE DRAWINGS

The invention, together with further aspects, objects and advantages thereof, will be best understood with reference to the following specification considered in connection with the accompanying drawings, in which.

DESCRIPTION OF THE PREFERRED EMBODIMENTS

Figure 1:
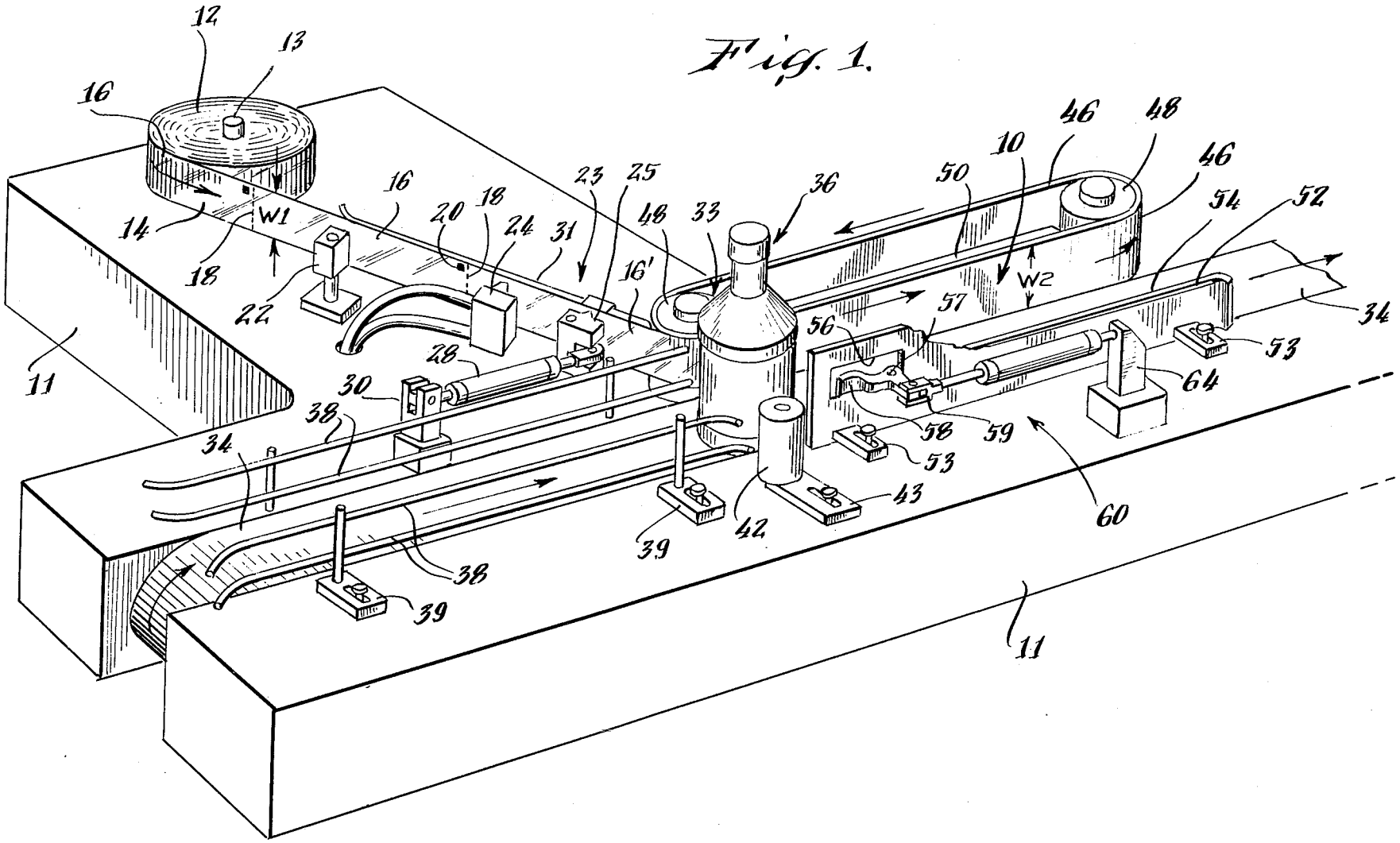
FIG. 1 is a perspective view illustrating the new and novel method and apparatus embodying the present invention.

Referring now to FIG. 1, the method and apparatus for automatically labelling containers in accordance with the present invention includes a labelling channel, referred to generally with the reference character 10 on a machine frame 11. In the channel 10 each of the containers 36 is rolled in sequence for wrapping the label around the container. In order to supply the labels there is a supply roll 12 of labels in a web 14, a sensor 22 for sensing registration indicia on each label, an adhesive applicator 24 for selectively applying adhesive to the labels, and a clamp station 23 for temporarily clamping the web 14 during separation of the leading label 16' from the web.

The supply roll 12 comprises a continuous web 14 of preprinted labels 16 arranged end-to-end in the web 14 having a width W1 which is suitable for the particular height of the container to be labelled. The web 14 may be of any suitable printable label material, for example such as transparent plastic or the like, on which reverse printing may be employed; that is, the printing is on the side of the web which will ultimately become the inside surface of the label. Regular printing on the outside surface may also be employed. The web 14 may also be made of other suitable printable label material such as paper. If desired, the web may contain a transversely extending line 18 of preformed perforations located between each successive label for facilitating separation of each label from the remainder of the web. However, various convenient label separation operations may be performed as described in which perforation of the web of labels is not employed.

One of the advantages of employing the supply roll 12 is the economies provided in the label material, printing and fabrication costs with respect thereto. For example, a high-speed printing machine can be used to preprint many parallel rows of labels on a wide web of plastic or other suitable label material, which may then be longitudinally slit into many individual narrow webs each of which contains a single row of labels and is wound in an individual roll. Such rolls of preprinted labels can be conveniently shipped and stored for long periods of time with no deleterious effects.

The supply roll 12 is mounted on a post 13, and the web 14 of labels 16 has transverse perforations 18 thereon as well as registration indicia or marks 20 on each label in a predetermined position, such as in a corner. The web 14 of labels 16 is fed from the roll 12 past a sensor 22 of any suitable type such as a photoelectric cell for sensing the registration indicia 20 on each label 16. The signal generated by the sensor 22 on the detection of such a registration indicia 20 is utilized for synchronizing and controlling the operation of the apparatus, as will be explained in connection with FIG. 9.

Next, the web 14 passes by an adhesive applicator 24 of conventional type which effectively applies an appropriate amount of heated, pressure-sensitive adhesive to predetermined localized regions on the inside of each label 16 in succession as the web 14 passes the adhesive applicator 24. The operation of the adhesive applicator 24 is controlled by the sensor 22 so that the spots or bands of applied adhesive are located in the same corresponding regions on each label.

After the adhesive is applied by the adhesive applicator 24, the web 14 next passes through a clamping station 23 including a clamp 25 which is actuated in response to the sensor 22 for temporarily clamping the web 14 during separation of the leading label 16 from the web in a manner which will be described hereinafter. The clamp 25 is pivotally mounted at 26 (See also FIG. 4), and its other end is pivoted to the piston rod 27 of a pneumatic cylinder 28 which is anchored at its outer end in a bracket 30. A back-up clamp plate or anvil 32 is positioned in the clamp station 23 on the other side of the web 14 from the clamp 25. Thus, when the cylinder 28 is actuated, the clamp 25 moves the web into contact with the anvil 32 for holding the web securely therebetween until released by the cylinder 28 after separation of a label 16 from the web 14, as will be explained later. A guide 31 directs the web 14 to a label-engaging station 33 where the leading edge of the leading label is first brought into engagement with a container.

Figure 2:
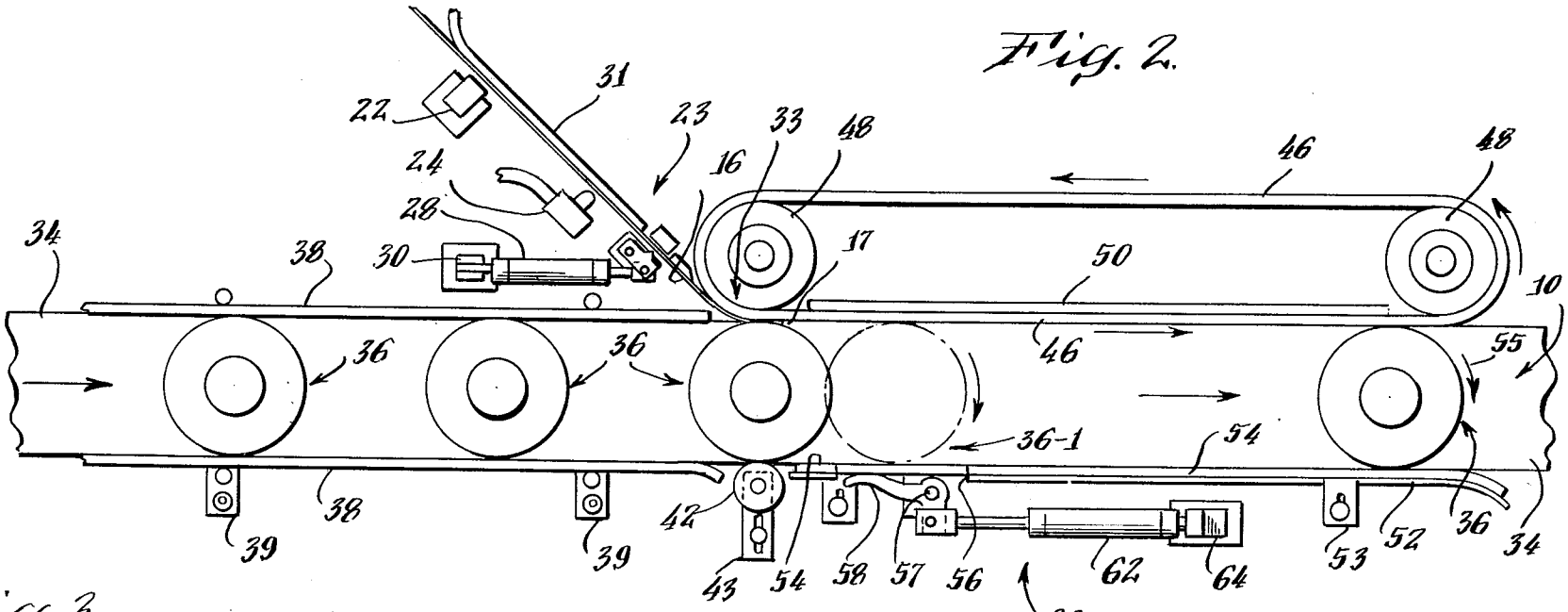
FIG. 2 is a partial top plan view of the apparatus shown in FIG. 1.
Figure 3:
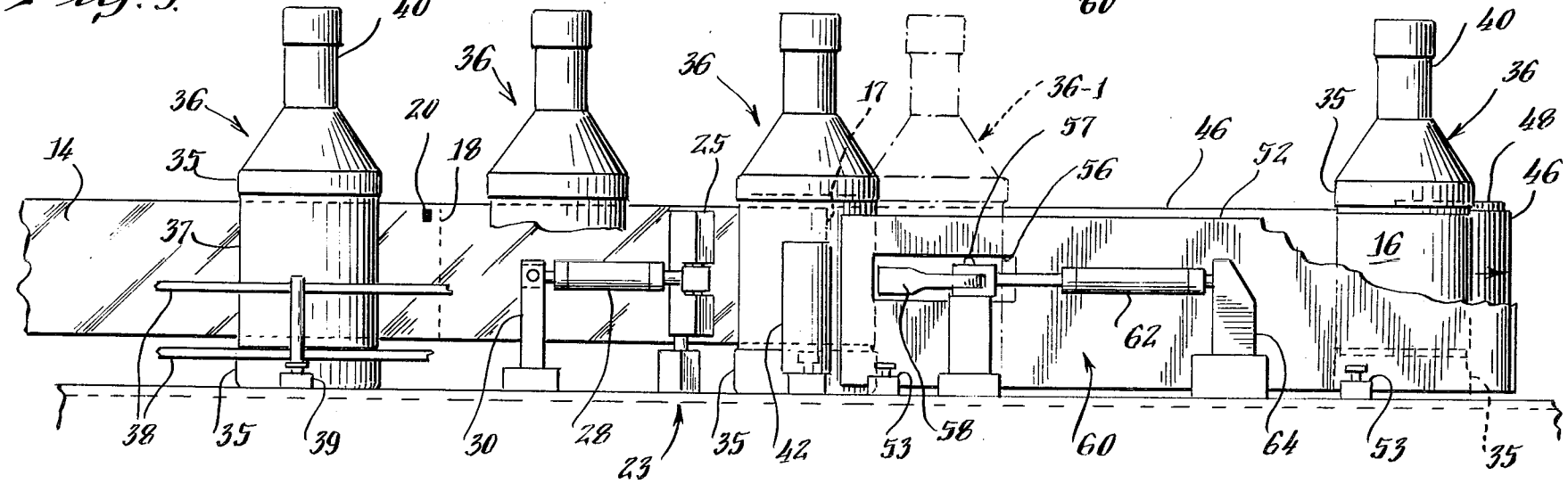
FIG. 3 is a front elevational view illustrating the method and apparatus shown in FIG. 2 with a series of individual containers being passed to the label-engaging station and being labeled in the labelling channel.

A conveyor belt 34 is utilized for transporting a series of individual containers 36 as shown in FIGS. 2 and 3 to the label-engaging station 33 and then into the labelling channel 10. The conveyor belt 34 is fenced on both sides with railings 38 supported on adjustable mounts 39 adjacent to the conveyor belt which direct the containers 36 to the label-engaging station 33. By making the railing 38 adjustable, various sized containers may be accommodated.

Although railings 38 are shown, it is to be understood that they are serving as guide means working in conjunction with the conveyor belt 34. Therefore, these railings 38 can be replaced by any suitable longitudinal guide means such as a pair of spaced parallel walls, at least one of which may be adjustable for adjusting the spacing between these guide walls.

The container 36 illustrated is a circular cylindrical molded plastic bottle having a slightly recessed or inset cylindrical surface 37 to which the labels are to be applied. Above and below the recessed surface 37 there are slightly protruding cylindrical surfaces or shoulders 35 (see also FIG. 3) which protect the label and serve to retain the label in place. The particular type of container 36 as shown has a relatively long neck 40 which is adapted to be inserted into the fill pipe of automotive vehicles, because this type of container is currently being used for packaging gasoline antifreeze. The width of the label-receiving surface 37 is slightly larger than the width W1 of a label 16. It will be appreciated however that this recessed surface is not necessary and further that other types and sizes of containers which are cylindrical with a circular cross-section may be utilized in accordance with the present invention.

The recessed surface 37 has been used in the past to define the labelling area, and in one form of prior art labelling operation which has been described in the introduction a tubular label is manually slipped over the container 36 and positioned on this recessed circular surface 37.

Figure 4:
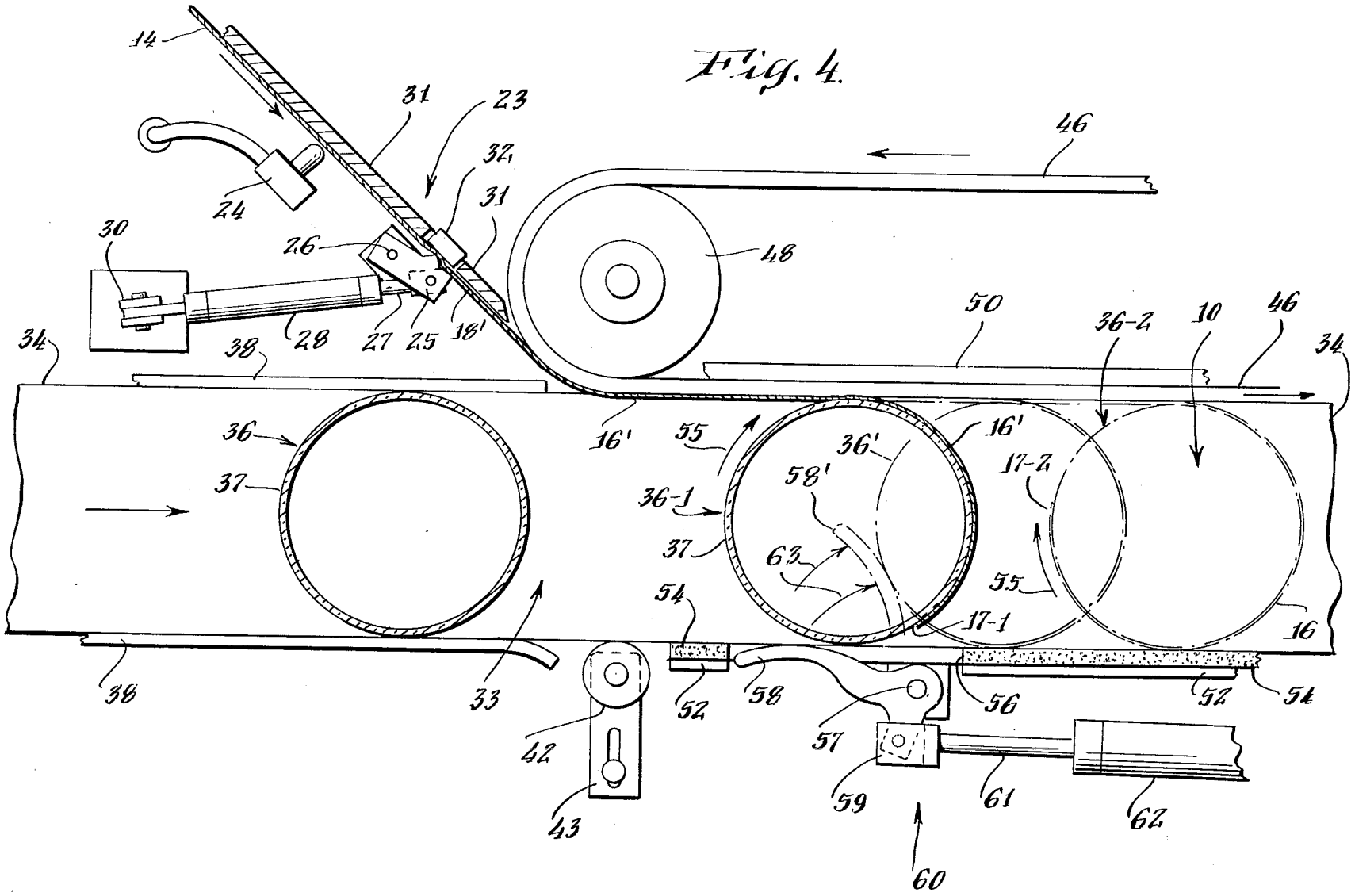
FIG. 4 is an enlarged partial top view of the apparatus seen in FIGS. 2 and 3, shown partially in section illustrating one form of label separation from the web.

At the label-engaging station 33 and along the labelling channel 10 an endless belt 46 is mounted revolving on rollers 48. The width W2 of the endless belt 46 is comparable with the width W1 of the label 16, and is positioned at an elevation for engaging the label being wrapped around the container in the channel 10 as shown in FIG. 4. The continuously revolving belt 46 is made of a suitable flexible material having a high friction surface such as Neoprene and is provided with a stationary back-up plate 50 extending along behind the moving belt 46 which forms one wall of the labelling channel 10. The other side of this labelling channel 10 is defined by a stationary wall 52 having a resilient friction pad 54 positioned on its front surface and having a window 56 positioned in an upstream portion of the wall 52. The wall 52 is mounted on adjustable mounts 53 to provide for adjustment in the width of the labelling channel 10. This labelling channel 10 may also be considered as a conveyor channel for there is the conveyor belt 34 extending along the bottom of this channel and the moving belt 46 extending along one side of this channel for rolling the containers along against the stationary friction wall surface 54, as shown in FIGS. 2 and 4 by the roll arrows 55.

The leading edge 17 (FIG. 2) of the leading label 16 which is fed along the guide 31 is temporarily positioned in the label-engaging station 33 with its sticky or tacky surface facing toward the entrance into the labelling channel 10. A pinch roller 42 mounted on an adjustable mount 43 at the upstream end of the channel 10 drives a container 36, which has been fed to the station 33 via the conveyor belt 34, into firm contact with the tacky surface near the leading edge 17 of the label 16 and thereby pushes the outside of this label firmly against the continuously revolving belt 46. The continuously revolving belt 46 immediately begins rotating the label-engaging container 36 by rolling it againts the resilient friction pad 54 on the opposed wall 52.

FIG. 2 illustrates the action of the pinch roller 42 in forcing the bottle 36 into contact with the leading edge portion 17 of a label while forcing the outside of the label 16 against the endless belt 46 which drives the bottle 36 downstream rolling it along in the conveyor channel 10 while wrapping the label 16 therearound it as it rolls. FIG. 3 is a front elevation illustrating these same operations as shown in FIG. 2.

The labelling channel 10 also includes what will be referred to as a label breaker 60 (show most clearly in FIG. 4) in the form of a foot 58 mounted on a pivot 57 and attached by a clevis 59 to a piston rod 61 driven by a cylinder 62 mounted on a bracket 64. The purpose of this label breaker is to separate the leading label from the web 14. The foot 58 of the label breaker 60 in its retracted location is positioned adjacent to the window 56 in the wall 52.

As is illustrated in FIG. 4, as soon as a sufficient wrap of the label 16 has occurred, the container or bottle at 36′ is struck or given a sudden downstream push or impulse 63 by the sudden impact of the movable foot 58 actuated by the cylinder 62. Immediately prior to this impact applied by the label breaker 60, the web 14 has been temporarily restrained by actuation of the clamp 25 as controlled by the sensor 22. The same sensor control with a slight delay actuates the cylinder 62 to apply the label-separating impact 63. Consequently, the sudden push 63 by the label breaker 60 serves to separate the partially wrapped label 16′ (FIG. 4) along the perforations 18′ (FIG. 4). Rolling of the container 36 continues down the conveyor channel 10 completing the wrapping of the tacky label 16′ onto the container 36.

As shown in FIG. 4, when a container has been rolled to the position 36-1, the leading edge portion of the label 16′ being wrapped will have approximately reached the position 17-1. When a container has been rolled further along the channel 10 to the position 36-2, the leading edge portion of the label 16′ will have been wrapped to the position 17-2, and so forth. It is noted that the container is being rolled along the friction wall 54 with the axis of the container oriented vertical. The leading edge 17 (FIG. 2) of the next label 16 is subsequently advanced into position to be attached to the next container and may be aided in being held near the travelling belt 46 by electrostatic attraction whereby the label 16 tends to cling to the moving belt 46.

The process therefore involves transporting a series of individual containers 46 to the label-engaging station 33 while feeding a continuous web of preprinted labels 16 to this station 33. Registration indicia 20 on the labels are sensed by the sensor 22 as the web 14 is fed to the label-engaging station. Adhesive is selectively applied to the web 14 of preprinted labels, and the leading edge portion 17 (FIG. 2) of each label 16 is attached to a container by pressing the leading edge of the label (having adhesive thereon) into contact with the container which is performed in the label-engaging station 33 at the upstream end of the labelling channel 10 by the pinch roller 42 in cooperation with the endless belt 46. The label is wrapped around the rolling container as the container is rolled by the endless belt 46 against the resilient pad 54 of the wall 52. The partially wrapped label is separated from the web by temporarily clamping the web with the clamp 25 in response to control by the sensor 22, and then impacting the container 36 by the label breaker 60.

The method so described is automatic and is continuous in labelling each successive container without interruption in the sequence of operations. This method and apparatus save material and are fully automated thereby eliminating many costly manual steps. No throw away backing strips are required on the labels. Adhesive is selectively applied to each label as required and is applied immediately prior to the labelling operation, so it cannot become stale.

Figure 5:
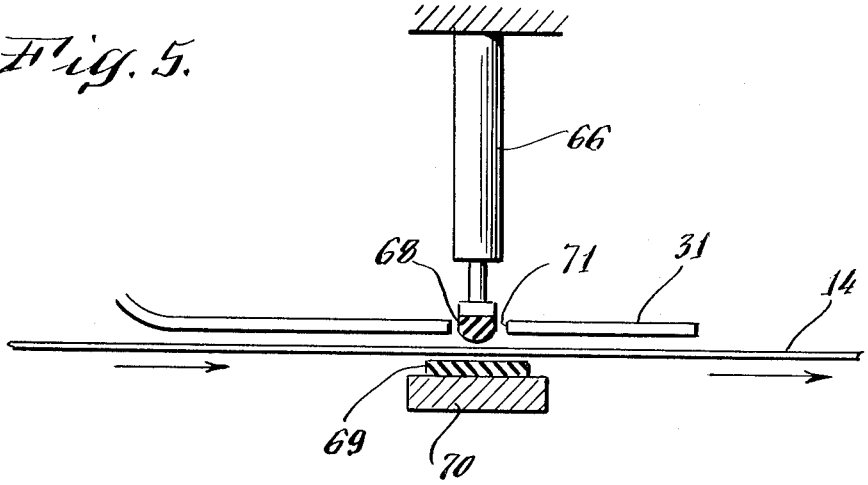
FIG. 5 is a top plan view of an alternative clamping mechanism for clamping the web of labels during separation of the leading label from the web.

FIG. 5 illustrates an alternative clamping arrangement for the clamp station 23 as illustrated in FIGS. 1 through 4. In this embodiment of FIG. 5 a pneumatic cylinder 66 drives a resilient clamp head 68 against the web 14 holding the web against a friction pad 69 mounted on a stationary anvil or back-up clamp member 70. The pneumatic cylinder 66 is mounted behind the web guide wall 31, and the resilient clamp head is normally retracted into a window 71 in the guide wall 31.

Figure 6:
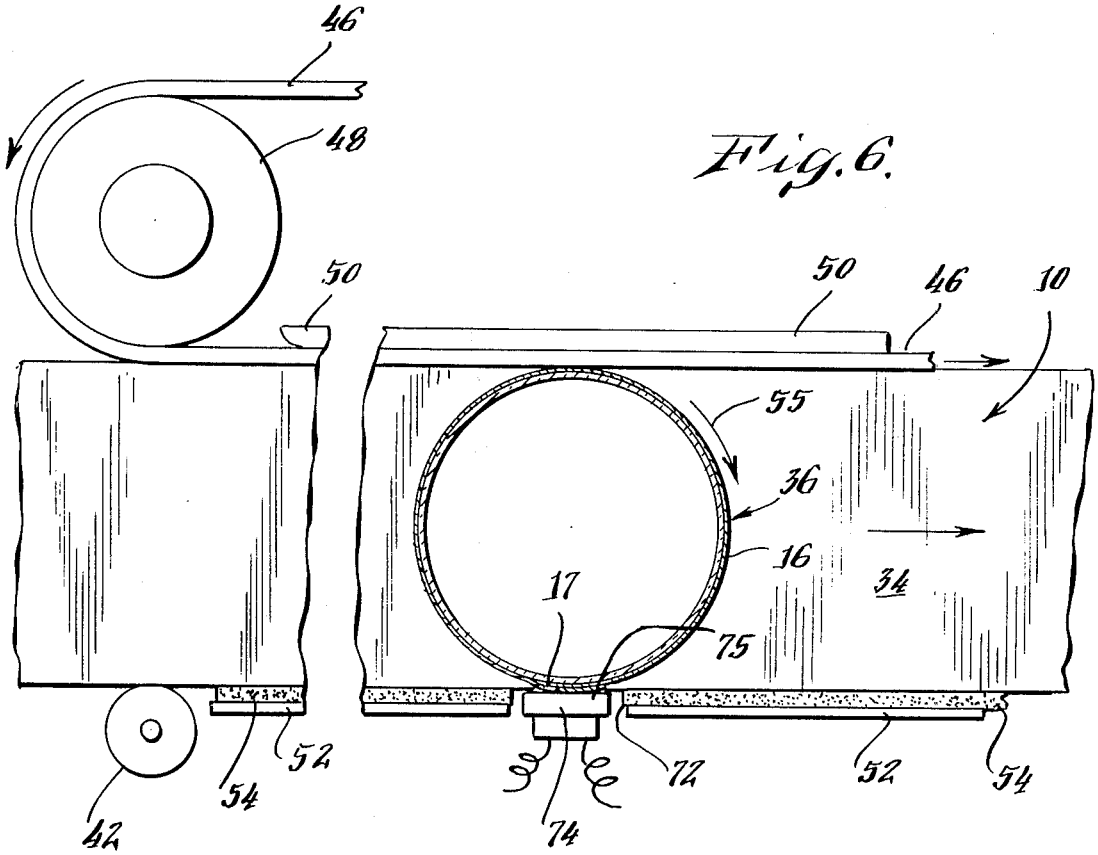
FIG. 6 is a partial top plan view of the labelling channel illustrating use of heat sealing for securing the labels to the containers.

FIG. 6 illustrates the heat sealing of the leading and trailing edges of a label 16 after the label has been separated and completely wrapped around the container 36. An electrically energized heat sealer 74 positioned in an opening 72 in the wall 52 is located downstream in the conveyor channel 10 at a point approximating two full revolutions (rolling cycles) of the container 36 so that the label is completely wrapped thereon, at which time heat is applied by contact with the heat sealing element 74 to fuse the ends of the label 16 together. The heat sealer 74 includes an electric resistance heating element and its temperature is monitored as is known in the heat sealing art so that its exposed surface 75 is at an appropriate temperature for heat sealing together the overlapped edges of the label without damaging the container itself. The exposed surface 75 is of the heat conductivity, for example of aluminum, so that the desired amount of heat energy is conducted into the overlapped edges of the label as the container is rolling past the heat sealer 74. The use of the heat seal method advantageously enables the application of less adhesive.

It will be appreciated that the use of pre-perforated labels is not a necessity and other means may be employed for separating the labels instead of the pre-perforations 18 and the label breaker mechanism 60 illustrated in FIGS. 1 through 4.

Figure 7:
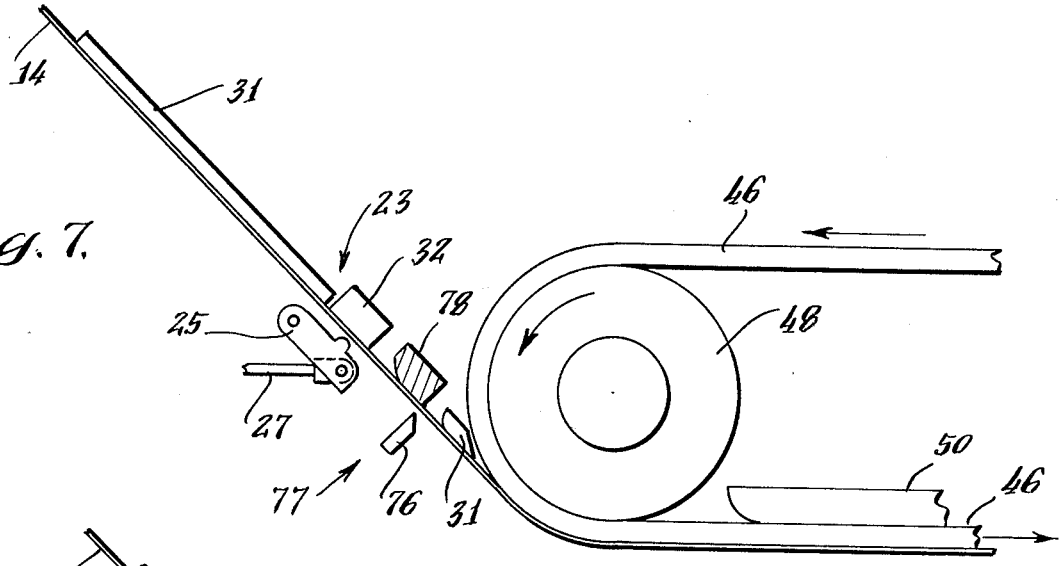
FIG. 7 is a partial top plan view illustrating an alternative embodiment for separating the labels from the web by cutting or shearing.

FIG. 7 illustrates the use of cutting means 77 including a knife blade 76 working against the edge of a shearing block 78 for separating the labels 16 from the web 14. Other suitable cutting or shearing means may also be employed.

Figure 8:
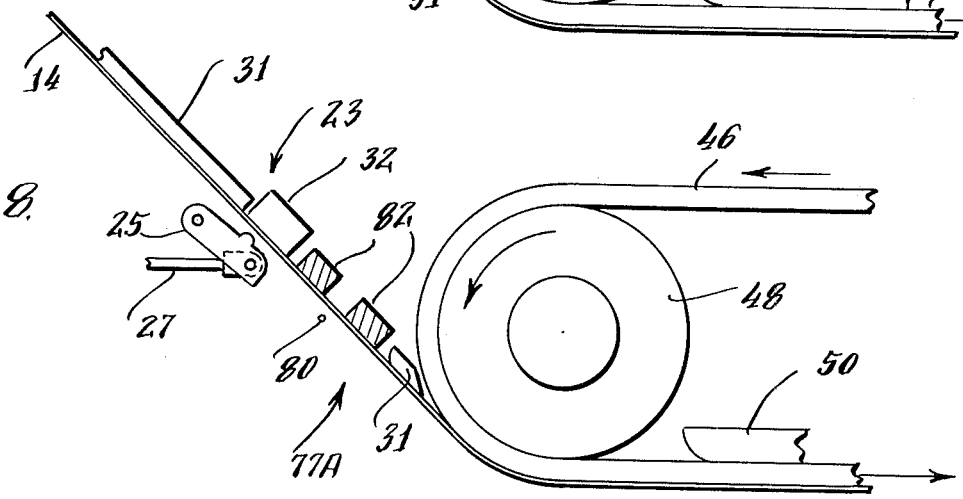
FIG. 8 is a partial top plan view like FIG. 7 to illustrate an alternative embodiment for separating the labels from the web utilizing a hot wire.

FIG. 8 illustrates the cutting of the label web 14 by a hot wire 80 which is heated by passing a current therethrough. The cutting is accomplished by moving the wire through the web 16 between a pair of back-up blocks 82. The cutting means 77 or 77A illustrated in FIG. 7 and 8, respectively, is positioned downstream from the clamp station 23 and upstream from the label-engaging station 33. The cutting means 77 or 77A is actuated in response to control from the sensor 22.

When it is desired to dispense the web of pre-printed labels without requiring the rotating bottle to pull the web for unwinding the roll 12 of labels, a pair of draw rolls (not shown) may be used to pull on the web located upstream from the conveyor channel 10.

Figure 9:
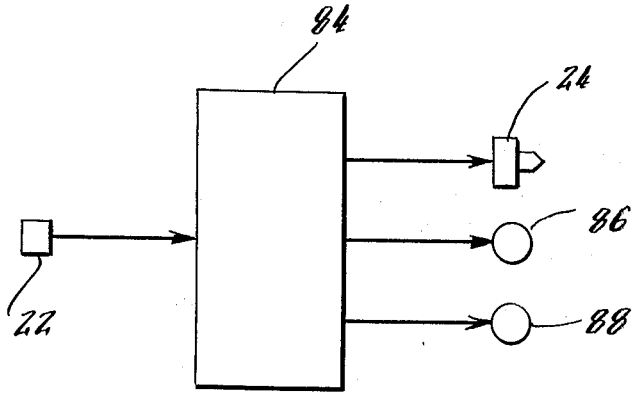
FIG. 9 is a schematic diagram showing the control circuit which is responsive to registration marks on each label.

As shown in FIG. 9 the sensor 22 is connected into a control circuit 84 which includes timers for producing the proper sequential operation of the various components as described above. The control circuit 84 is connected to the adhesive applicator 24 for causing application of the adhesive to the same predetermined localized areas of each label as desired. This control circuit 84 is also connected to a solenoid valve 86 for controlling the flow of compressed air to the clamp cylinder 28 (FIGS. 1, 2, 3 and 4) or to the clamp cylinder 66 (FIG. 5). There is also a connection to a solenoid valve 88 which serves to control the flow of compressed air to the label-breaker cylinder 62 (FIGS. 1, 2, 3 and 4).

In the event that a cutting mechanism 77 or 77A is employed as shown in FIG. 7 or 8, then the label-breaker mechanism 60 may be omitted. In such a case the solenoid valve 88 serves to control the flow of compressed air to the pneumatic cylinder (not shown) which moves the knife 76 or the hot wire 80.

Since other changes and modifications varied to fit particular operating requirements and environments will be apparent to those skilled in the art, the invention is not considered limited to the examples chosen for purposes of illustration and includes all changes and modifications which do not constitute departures from the true spirit and scope of this invention as defined in the appended claims:

We claim:

1. The method of automatically labelling containers comprising the steps of:

(a) transporting a series of individual containers to a label-engaging station, (b) feeding a continuous web of preprinted labels to the label-engaging station, (c) sensing a predetermined portion of each label as the web is being fed to the label-engaging station, (d) selectively applying an adhesive to the web of preprinted labels, (e) attaching the front edge of the leading label in the web to a container by pressing the front edge of the label having adhesive thereon into contact with the container at said label-engaging station, (f) wrapping the attached label around the container by rolling the container, (g) in response to said sensing temporarily clamping the web, and (h) separating the label from the web as the label is being wrapped around the container by rolling the container.

2. The method of automatically labelling containers as set forth in claim 1 including the steps of:

pre-perforating the continuous web of preprinted labels along transverse lines of perforations between each successive label, and impacting the rolling container after a sufficient wrap of the label has occurred and while the web is temporarily clamped for separating the attached and wrapped label from the web.

3. The method of automatically labelling containers as set forth in claims 1 or 2 including the step of:

heat sealing the overlapped ends of the wrapped label after the label has been separated from the web and wrapped around the container.

4. The method of automatically labelling containers as set forth in claim 1 wherein:

said step of separating the label from the web comprises cutting the label while the web is temporarily clamped.

5. The method of automatically labelling containers as set forth in claim 1 wherein:

said step of separating the label from the web comprises passing a hot wire through the web while the web is being temporarily clamped.

6. The method of automatically labelling containers as set forth in claim 1, in which:

the container has a generally circular cylindrical configuration in the region where the label is being applied, and the attached label is wrapped around the container by rolling the container with its axis vertical.

7. The method of automatically labelling containers as set forth in claim 6, in which:

the container having the front edge of the label attached thereto is rolled downstream along a wall surface by a moving belt positioned in opposition to the wall surface and pressing against the opposite side of the container from the wall surface for wrapping the label around the container.

8. Apparatus for automatically labelling containers comprising:

(a) a label-engaging station, (b) conveyor means for continuously transporting a series of individual containers to be labelled to said label-engaging station, (c) label feeding means having a supply roll comprised of a continuous web of preprinted labels being fed to said label-engaging station, (d) sensing means positioned for sensing a pre-determined portion of each passing label in said web, (e) adhesive applicator means for applying a pressure-sensitive adhesive to each passing label in said web, (f) the leading edge of each label being fed to said label-engaging station with the adhesive surface thereon facing toward the individual containers transported by said conveyor means to said label-engaging station, (g) a continuously revolving belt having a friction surface thereon forming one wall of a labelling channel and an opposed wall spaced from said belt and forming the opposite wall of the labelling channel, (h) pinch means at said label-engaging station for driving a container into firm contact with said adhesive surface on said leading edge of a label while pressing the opposite side of the label against said continuously revolving belt, (i) said revolving belt rolling said container along said opposed wall in said channel thereby wrapping said label around said container, and (j) separation means controlled by said sensing means for separating the leading label from said web.

9. The apparatus set forth in claim 8 in which: said separation means comprises a hot wire which is passed through said web for separating the leading label therefrom.

10. The apparatus set forth in claim 8 in which: said separation means comprises cutting means for cutting the leading label from said web.

11. The apparatus set forth in claim 8 in which:

said web of preprinted labels is perforated between each label to facilitate label separation, and said separation means includes means for temporarily clamping the web and label-breaking means controlled by said sensing means for impacting the container for applying a downstream impulse to the container after a sufficient wrap of the label has occurred and while the web is temporarily clamped.

12. The apparatus set forth in claim 11 in which:

said label-breaking means comprises a cylinder which drives a striking member coupled thereto for striking a container in said channel when said cylinder is activated in response to said sensing means.

13. The apparatus set forth in claim 8 or 11 including:

heat sealing means positioned downstream in said channel for sealing the overlapped ends of a label on said container after the label has been completely wrapped around said container.

* * * * *